US005335803A

United States Patent [19]

O'Brien et al.

[11] Patent Number: 5,335,803

[45] Date of Patent: Aug. 9, 1994

[54] ROTATABLE FOOD TRAY FOR OUTDOOR PATIO FURNITURE

[76] Inventors: Diana A. O'Brien; Leo J. O'Brien, both of 1012 SW. 8yh St., Fort Lauderdale, Fla. 33315

[21] Appl. No.: 942,744

[22] Filed: Sep. 9, 1992

[51] Int. Cl.[5] ..... A47F 5/02

[52] U.S. Cl. ..... 211/163; 211/107; 108/50

[58] Field of Search ..... 211/163, 107, 131, 144; 108/50; 135/15.1, 16, 19.5, 34.4, 48, 98

[56] References Cited

U.S. PATENT DOCUMENTS

| | | | |
|---|---|---|---|
| 457,149 | 5/1892 | Pearson | 211/107 |
| 2,589,719 | 3/1952 | McKinney | 108/50 |
| 3,101,849 | 8/1963 | Osborn | 211/131 |
| 3,194,403 | 7/1965 | Van Hora, Jr. | 211/107 |
| 3,624,732 | 11/1971 | Bowden | 108/50 |
| 3,910,631 | 10/1975 | Inaba | 135/16 |
| 4,501,201 | 2/1985 | Fitzner et al. | 211/107 |
| 4,584,946 | 4/1986 | Tucker et al. | 108/50 |
| 4,762,237 | 8/1988 | Newton | 211/131 |
| 4,920,897 | 5/1990 | Reed et al. | 108/150 |
| 5,161,561 | 11/1992 | Jamieson | 135/16 |

*Primary Examiner*—P. Austin Bradley
*Assistant Examiner*—Chuck Y. Mah
*Attorney, Agent, or Firm*—Malin, Haley, DiMaggio & Crosby

[57] ABSTRACT

A rotatable food tray for use in combination with an outdoor patio table having an umbrella. The food tray includes a centrally disposed aperture to accommodate the support post of the umbrella. A base support member is placed beneath the food tray for free rotation of the tray in relation to the table. The support member can be placed directly on the eating surface, or alternatively, placed at any position along the length of the umbrella support post by use of extension posts or support pins associated with the umbrella post. The rotatable tray is available for placement of foods, utensils, and like items utilized during a meal, allowing ease of access by manual rotation of the tray. An inner and outer raised lip is provided about the periphery of the tray to contain fluid spills. The device can be made into a two tier or three tier apparatus by placement of additional rotatable trays at a predetermined distance above the base rotatable tray.

10 Claims, 2 Drawing Sheets

ROTATABLE FOOD TRAY FOR OUTDOOR PATIO FURNITURE

BACKGROUND OF THE INVENTION

1. Field of the Invention

This invention relates to rotatable food trays and, more particularly, to a rotatable food tray for use in combination with outdoor patio tables having an umbrella disposed in the middle of said table.

2. Description of the Prior Art

Outdoor tables, once considered the design oddity of a cottage industry, has evolved into a formidable market for home enjoyment. Table furniture now includes artistically coordinated chairs, seat covers, table tops, and lately, the use of umbrellas that encompass the table. The umbrella has become a mainstay in the use of outdoor table furniture, providing those who are seated at the table a form of protection from sunlight, rain, or other elements that may fall from above. Placement of the umbrella at the center of the table, the table accommodating the umbrella by use of a centrally disposed aperture, provides an encompassing shelter over a perimeter of the table.

Similar to indoor tables, the umbrella table has a variety of uses, none more important than that of a sitting location for the consumption of food. However, unlike the indoor table counterparts, the use of an umbrella provides an additional obstacle when used for the consumption of food. That is, a centrally located umbrella pole that the participants at the table must pass food or dishes around. The umbrella pole creates not only an obstacle but it consumes critical space in the middle of the table.

Many indoor tables have utilized a rotatable tray placed in the center thereof that allows the tray to rotate in a circular direction in relation to the table. The rotatable tray allows any individual situated at the table access to any plate or item placed upon the rotatable tray by simply rotating the perimeter of the tray until the item sought is in a position closest to the requester. With a centrally placed pole, the passage of food can be even more disrupting since multiple hands are required to pass the food around the pole to reach the requester. The conventional rotatable tray cannot be placed on a table having an umbrella for obvious reasons.

U.S. Pat. No. 3,951,079 issued to Telleson discloses a multi-tiered, rotatable tray which permits placement of food items upon a tray allowing the requester to simply rotate the perimeter of the tray until the item sought is closest to the person's position. The Telleson device is multiple level which provides additional table space by placement of the trays in a vertical position. A disadvantage to the Telleson device is that it cannot be utilized with an outdoor table having a centrally located umbrella stem since the device requires an independent centrally disposed support structure.

U.S. Pat. No. 3,139,189 issued to Kolarik discloses another type of rotatable food tray, wherein a two level tray is disclosed in combination with a cup holder designed to contain cards, certificates, flatware, and so forth. The disadvantage to the Kolarik device is similar to that of Telleson in that the umbrella table cannot accommodate the self-contained tray.

Thus, what is needed in the art is a rotatable tray that is capable of the functionality found on the conventional rotatable tray used on the indoor table, further providing a means for maintaining said rotatable tray in combination with a centrally located umbrella extending through a table.

SUMMARY OF THE INVENTION

The instant invention is a rotatable food tray for use in combination with an outdoor patio table which has a centrally placed umbrella. The rotatable food tray is a two piece construction which includes a centrally disposed aperture to accommodate the pole or support post of a conventional umbrella. A base support member is operatively associated with the lower surface of the rotatable food tray providing a frictionless bearing or the like surface and permitting free rotation in relation to the table. The support member can be placed directly on the eating surface of the outdoor table or, alternatively, placed at any position along the longitudinal height of the umbrella post. For instance, the base member can be supported by an exteriorly mounted hollow support shaft or an adjustable clamp affixed about the circumference of the support post. Once installed, the rotatable tray is available for placement of food, utensils, and like items, with the device allowing ease of access by manual rotation of the tray. The inner and outer perimeter of the rotatable tray includes a raised lip which is beneficial in containing fluid spills.

Accordingly, an objective of the instant invention is to provide a rotatable tray for outdoor patio furniture having an umbrella post located in the center of the furniture.

Yet another objective of the instant invention is to provide a two piece construction allowing attachment to the umbrella post without raising or otherwise removing the umbrella.

Another objective of the instant invention is to provide a means for positioning a rotatable tray in combination with an outdoor table having an umbrella post by use of a centrally disposed aperture through said tray and providing a means to support the tray at any position along the height of the support posts.

Other objects and advantages of this invention will become apparent from the following description taken in conjunction with the accompanying drawings, wherein are set forth by way of illustration example, certain embodiments of this invention. The drawings constitute a part of the specification that include exemplary embodiments of the instant invention and illustrate various objects and features thereof.

DESCRIPTION OF THE PREFERRED EMBODIMENTS

As required, detailed embodiments of the present invention are disclosed herein. However, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
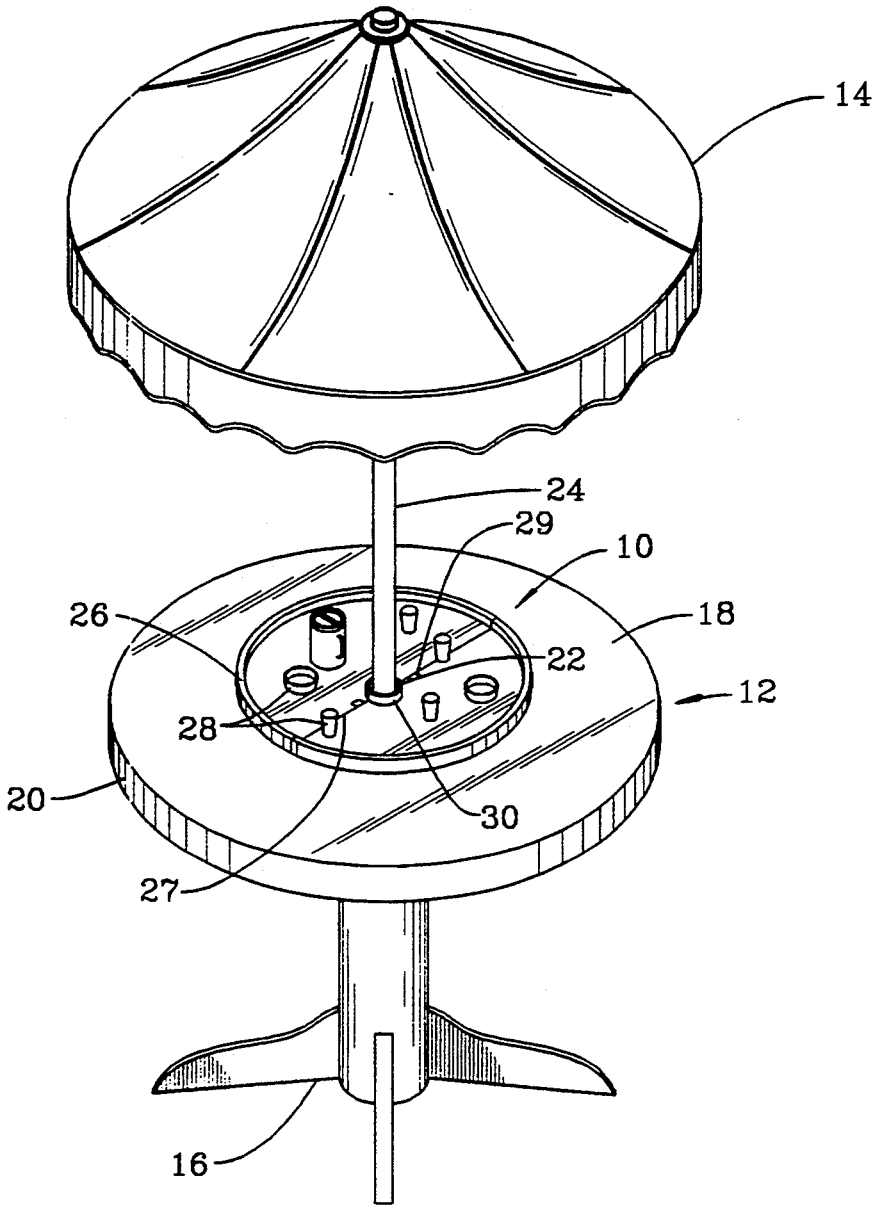
FIG. 1 is a perspective view of the rotatable food tray of the instant invention installed upon an outdoor table with an umbrella.

Now referring to FIG. 1, shown is the instant invention 10 installed upon a conventional outdoor patio table 12 having a fully extended umbrella 14. The outdoor patio table 12 consists of a base 16 for support of an eating surface 18 defined as a surface with a perimeter 20 and a centrally disposed aperture 22 for placement of the umbrella support post 24. The umbrella encompasses the eating surface 18 and typically the perimeter area 20 for protection of items placed thereon from direct sunlight, rain, and so forth.

The rotatable tray of the instant invention is generally depicted by numeral 10 and is further defined as a two piece circular plate constructed of plastic, wood, or coated metal. The plate has a predetermined outer perimeter 26 having a diameter sized in accordance with the surface of the patio table and particular desires of the consumer. The outer perimeter 26 is split into two pieces along opening 27 and includes a raised lip to prevent items 28 placed upon the surface of the plate 10 from sliding off and for containing spills. Along the length of the two piece construction is placed engagable tabs 29 and 31 which extend above and below the surfaces of the plate respectively. Tabs 29 and 31 securely lock the two plates together, whereby weight placed upon the plate forces the two plates into a single, coherent plate. The edges 27 of the plate can be made interlocking to form a leakproof barrier. Alternatively, a seal can be placed along the length of the plate. At the center of the plate 10 is a centrally disposed aperture defined by a lip 30 to contain spills.

Figure 1A:
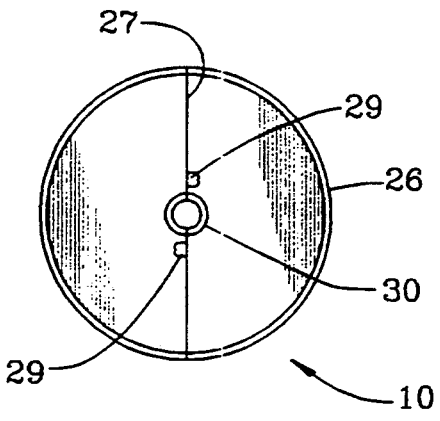
FIG. 1A is a top view of the rotatable food tray.
Figure 1B:
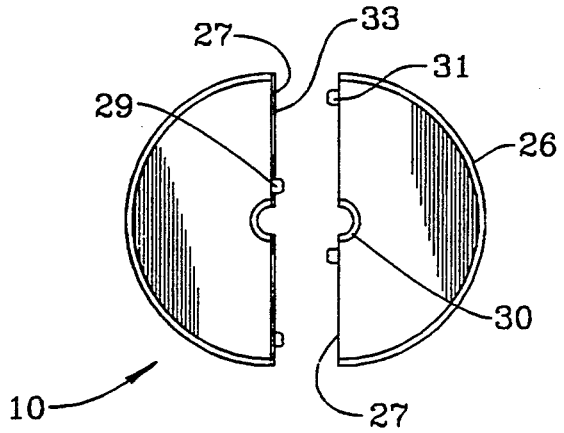
FIG. 1B is a top exploded view of the rotatable food tray.

FIG. 1A illustrates the top view of the rotatable tray 10 with tabs 29 overlapping the surface of the tray for locking the two halves along edge 27 in a single position. Perimeter edge 26 defining a circular structure upon locking of the tabs. FIG. 1B is provided to illustrate the use of bottom locking tabs 31 operatively associated with top locking tabs 29. Seal 33 can be placed along edge 27 to prevent liquids from dripping through the junction. The two piece design permits ease of coupling the two halves together about the umbrella stem.

Figure 2:
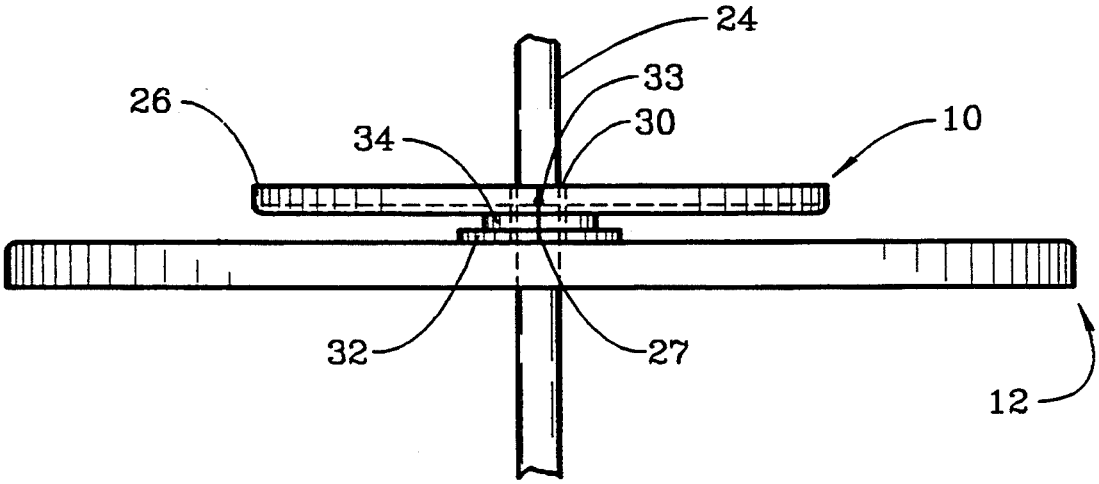
FIG. 2 is a side plan view of the rotatable food tray set on the top surface of an outdoor table.

FIG. 2 is a side view of the rotatable plate 10, illustrating a support post 24 of the umbrella extending through the surface of the outdoor table 12. The rotatable tray 10 is shown in a position wherein support member 32 is set against the upper surface 18 of the table 12 and a bearing housing 34 is placed between the support member 32 and the rotatable tray 10. As illustrated by this example, the rotatable tray includes lip 26 formed along the outer perimeter of the tray 10. Seal 33 is placed with edge 27. It should be obvious to one skilled in the art that the bearing 34 and base support 32 may be made integral with each other or in combination with the plate 10. The bearing support 34 provides a frictionless area of rotation between the base and the bottom of plate 10.

Figure 3:
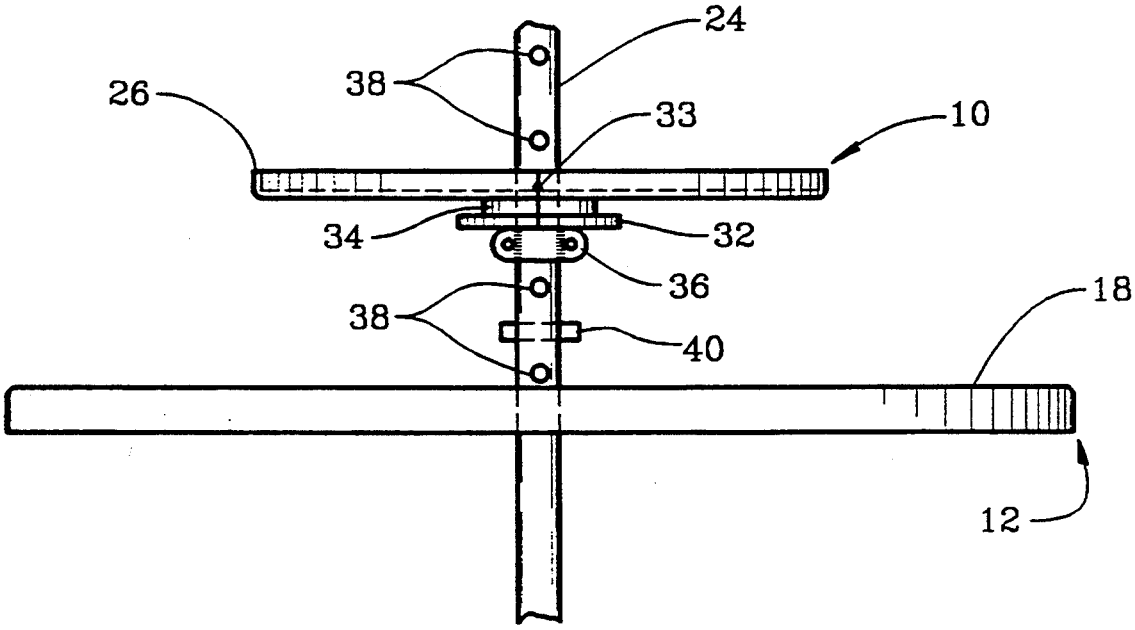
FIG. 3 is a side plan view of the rotatable food tray mounted a vertical distance above the surface of an outdoor table by a support clamp.

Now referring to FIG. 3, shown is a raised embodiment of the instant invention. In this embodiment the support post 24 extends through the table surface 18 of the patio table 12. The rotatable tray 10 is placed at a predetermined height along the longitudinal length of post 24 by use of support clamp 36 affixed about the circumference of post 24. The support member 32 is then adjustably biased along the top of the fixation device 36. The bearing 34 or like frictionless surface allows the rotatable plate 10 to freely rotate about the circumference of the post. The support clamp can include a length of pipe for insertion into the aperture 22 or simply provide a base support.

Alternatively, the instant invention can be sold in combination with an umbrella wherein support post 24 includes a plurality of through holes 38 allowing support at any location along the length of post 24 by insertion of support pin 40. Through holes are placed along the length at perpendicular points to maintain post integrity. Still another embodiment, not shown, is the use of spring loaded support pins permanently attached to the support post 24. Functionally equivalent to support pin 40, the spring loaded support pins provide biasing at predetermined locations along the length of the post. The center aperture 22 of the plate 10 can be made a narrow tolerance to provide upright alignment and prevent plate wobble.

Still another embodiment of the instant invention, not shown, is to support the plate a predetermined distance above the surface of the table by use of a circular encompassing pipe in place of the stem attachment device. The plate is allowed to rotate at a fixed distance above the surface of the patio table with the support member biased directly against the table. The extension pipe can be used to accommodate additional rotatable plates in various sizes, allowing a two or even three tier apparatus, allowing for optimum use of the eating surface.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An outdoor service system comprising:

an umbrella support post;

an outdoor patio table having a generally flat eating surface and a centrally disposed aperture, said patio table aperture available for insertion of said umbrella post;

a rotatable food tray, said rotatable food tray comprising two completely separate, substantially semi-circular halves, each of said halves having a substantially semi-circular notch disposed proximate the center of its non-arcuate edge, each of said halves further having an engagable tab disposed along its non-arcuate edge, said tabs frictionally engaging a respective upper and lower surface of said rotatable food tray when said two halves are engaged, securely locking said two halves together, such that said two halves form a centrally disposed aperture, said centrally disposed aperture available for insertion of said umbrella post;

means for maintaining said food tray at a predetermined distance in a substantially parallel plane to the eating surface of said outdoor table; and a means for rotating said food tray about said umbrella post.

2. The outdoor service system according to claim 1, wherein said rotatable food tray is further defined as having a first raised peripheral lip along its outer circumference and a second raised peripheral lip along the circumference of said centrally disposed aperture.

3. The outdoor service system according to claim 1, wherein said rotatable food tray includes a means for sealing.

4. The outdoor service system according to claim 1, wherein said means for maintaining said food platform at a predetermined distance includes a support member biased against the eating surface of the patio table.

5. The outdoor service system according to claim 1, including a means for biasing said support member along a longitudinal length of the umbrella support post, in conjunction with the umbrella support post.

6. The outdoor service system according to claim 5, wherein said means for biasing is defined as a conventional pipe clamp frictionally engaging the umbrella support post.

7. The outdoor service system according to claim 1, wherein said means for rotating is defined as a frictionless bearing operatively associated with said support post.

8. The outdoor service system according to claim 1, wherein said means for rotating is defined as a support plate having at least one detente groove for placement of a plurality of ball bearings to create a bearing race, said support plate operatively associated with the bottom surface of said food tray, allowing rotation therewith.

9. An outdoor service system comprising:

an umbrella support post having a plurality of through holes;

an outdoor patio table having a generally flat eating surface and a centrally disposed aperture, said patio table aperture available for insertion of said umbrella post;

a rotatable food tray, said rotatable food tray comprising two completely separate, substantially semi-circular halves, each of said halves having a substantially semi-circular notch disposed proximate the center of its non-arcuate edge, each of said halves further having an engagable tab disposed along its non-arcuate edge, said tabs frictionally engaging a respective upper and lower surface of said rotatable food tray when said two halves are engaged, securely locking said two halves together, such that said two halves form a centrally disposed aperture, said centrally disposed aperture available for insertion of said umbrella post;

said rotatable food tray further having a first peripheral lip along its outer circumference, a second peripheral lip along the circumference of said centrally disposed aperture, said centrally disposed aperture available for insertion of said umbrella support post;

a support pin available for insertion into one of said through holes along the length of said umbrella support post; and a means for allowing said rotatable food tray to rotate about said umbrella support post, whereby said umbrella support post is inserted into the aperture in said outdoor table and said support pin is disposed in said support post at a predetermined distance above the eating surface of the table, said rotatable food tray placed thereon and made available for placement of food for ease of access by rotation thereof.

10. The outdoor service system according to claim 9, wherein said support pin is spring biased.

* * * * *